US007997943B2

(12) United States Patent
Gregory et al.

(10) Patent No.: US 7,997,943 B2
(45) Date of Patent: Aug. 16, 2011

(54) TRANSVERSE WEDGE CONNECTOR

(75) Inventors: Owen Ross Gregory, Apex, NC (US); Charles Dudley Copper, Hummelstown, PA (US); Terry Edward Frye, Cary, NC (US); Alexandre Marc, Toronto (CA); Barry Johnson, Vaughan (CA); Vladimir Hoxha, Toronto (CA)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/509,246

(22) Filed: Jul. 24, 2009

(65) Prior Publication Data

US 2010/0015862 A1 Jan. 21, 2010

Related U.S. Application Data

(63) Continuation-in-part of application No. 11/930,868, filed on Oct. 31, 2007, now Pat. No. 7,677,933, which is a continuation-in-part of application No. 11/437,480, filed on May 18, 2006, now Pat. No. 7,309,263.

(51) Int. Cl.
*H01R 4/44* (2006.01)

(52) U.S. Cl. ..... 439/782

(58) Field of Classification Search ..... 439/782, 439/783, 781, 784; 174/94 S, 94 R
See application file for complete search history.

(56) References Cited

U.S. PATENT DOCUMENTS 3,026,497 A 3/1962 Myers et al.
3,088,993 A * 5/1963 Matthysse ..... 174/71 R
3,924,920 A 12/1975 Moscioni et al.
4,247,159 A 1/1981 Fruchard
4,279,461 A 7/1981 Bussen et al.
4,384,753 A 5/1983 Mixon, Jr.
4,471,159 A 9/1984 Frank, Jr.
4,684,196 A 8/1987 Smith et al.
4,723,921 A 2/1988 Pooley
4,764,131 A 8/1988 Beinhaur
4,825,513 A 5/1989 Verespej (Continued)

FOREIGN PATENT DOCUMENTS

DE 537210 10/1931

(Continued)

OTHER PUBLICATIONS

J.D. Sprecher, et al "Wedge-Connector Technology in Power Utility Applications"; AMP Journal of Technology, Jun. 1996, vol. 5, Tyco Electronics Corporation; 10 pgs.

(Continued)

*Primary Examiner* — T C Patel
*Assistant Examiner* — Harshad C Patel

(57) ABSTRACT

An electrical connector assembly includes a first conductive member and a second conductive member. The first conductive member includes a first channel portion extending from a first wedge portion, with the first channel portion configured to receive a first conductor therein. The first conductive member includes a jaw movably coupled to the first channel portion and being positioned between the first channel portion and the first wedge portion. The second conductive member includes a second channel portion extending from a second wedge portion where the second channel portion configured to receive a second conductor. The first wedge portion and the second wedge portion are assembled such that the second wedge portion engages the jaw and moves the jaw to the closed position. The jaw engages the first conductor in the closed position. Optionally, the first channel portion may have a contoured shape.

24 Claims, 11 Drawing Sheets

U.S. PATENT DOCUMENTS

| | | | | |
|---|---|---|---|---|
| 4,857,020 | A | 8/1989 | Crosby | |
| 4,872,856 | A | 10/1989 | Pooley et al. | |
| 4,915,653 | A | 4/1990 | Mair | |
| 5,145,420 | A | 9/1992 | Counsel et al. | |
| 5,342,224 | A | 8/1994 | Lefavour | |
| 5,692,930 | A | 12/1997 | Garver et al. | |
| 5,704,816 | A | 1/1998 | Polidori | |
| 5,752,860 | A | 5/1998 | Greaves | |
| 5,944,564 | A | 8/1999 | Chadbourne et al. | |
| 6,004,165 | A * | 12/1999 | Dinh et al. | 439/783 |
| 6,086,406 | A | 7/2000 | Francois et al. | |
| 6,390,861 | B1 | 5/2002 | DeFrance | |
| 6,595,472 | B1 | 7/2003 | Pisczak | |
| 7,182,653 | B1 | 2/2007 | Hoxha | |
| 7,309,263 | B2 | 12/2007 | Copper et al. | |
| 7,387,546 | B2 | 7/2008 | Copper et al. | |
| 7,524,217 | B2 | 4/2009 | Copper | |
| D599,184 | S * | 9/2009 | Johnson et al. | D8/72 |
| 7,677,933 | B2 | 3/2010 | Copper et al. | |
| 7,713,099 | B2 * | 5/2010 | Lai | 439/783 |
| 2001/0044990 | A1 | 11/2001 | Turvey et al. | |
| 2002/0142674 | A1 | 10/2002 | Chadbourne et al. | |
| 2007/0004289 | A1 | 1/2007 | Hoxha et al. | |
| 2007/0270047 | A1 | 11/2007 | Cooper et al. | |
| 2008/0283686 | A1 | 11/2008 | Copper | |

FOREIGN PATENT DOCUMENTS

| | | |
|---|---|---|
| EP | 0342122 | 11/1989 |
| WO | WO 2007/136705 A2 | 11/2007 |

OTHER PUBLICATIONS

Office Action dated Aug. 15, 2006 for U.S. Appl. No. 11/437,480; (8 pgs.).
Final Office Action dated Jan. 18, 2007 for U.S. Appl. No. 11/437,480; (12 pgs.).
Office Action dated Oct. 29, 2007 for U.S. Appl. No. 11/804,065; (18 pgs.).
Final Office Action dated Feb. 28, 2008 for U.S. Appl. No. 11/930,713; (13 pgs.).
Office Action dated May 23, 2008 for U.S. Appl. No. 11/930,713; (9 pgs.).
Office Action dated Jun. 13, 2008 for U.S. Appl. No. 11/930,868; (16 pgs.).
Office Action dated Oct. 10, 2008 for U.S. Appl. No. 11/930,868; (12 pgs.).
Office Action dated Jan. 28, 2009 for U.S. Appl. No. 11/930,868; (10 pgs.).
Office Action dated Jun. 16, 2009 for U.S. Appl. No. 11/804,122; (5 pgs.).
Annex Form PCT/ISA/206, Communication Relating to the Results of the Partial International Search, Int'l Appln. No. PCT/2010/002072, International Filing Date Jul. 22, 2010.

* cited by examiner

TRANSVERSE WEDGE CONNECTOR

CROSS REFERENCE TO RELATED APPLICATIONS

This application is a continuation-in-part of U.S. application Ser. No. 11/930,868, filed Oct. 31, 2007, and entitled "STIRRUP-TYPE POWER UTILITY ELECTRICAL CONNECTOR", which is a continuation-in-part of U.S. application Ser. No. 11/437,480, filed May 18, 2006, and entitled "COMBINATION WEDGE TAP CONNECTOR" which issued as U.S. Pat. No. 7,309,263 on Dec. 18, 2007, the complete subject matter of both of which are hereby incorporated by reference in their entirety.

BACKGROUND OF THE INVENTION

The subject matter herein relates generally to electrical connectors, and more particularly, to power utility connectors for mechanically and electrically connecting a tap or distribution conductor to a main electrical transmission conductor.

Electrical utility firms constructing, operating and maintaining overhead and/or underground power distribution networks and systems utilize connectors to tap main power transmission conductors and feed electrical power to distribution line conductors, sometimes referred to as tap conductors. The main power line conductors and the tap conductors are typically high voltage cables that are relatively large in diameter, and the main power line conductor may be differently sized from the tap conductor, requiring specially designed connector components to adequately connect tap conductors to main power line conductors. Generally speaking, three types of connectors are commonly used for such purposes, namely bolt-on connectors, compression-type connectors, and wedge connectors.

Bolt-on connectors typically employ die-cast metal connector pieces or connector halves formed as mirror images of one another, sometimes referred to as clam shell connectors. Each of the connector halves defines opposing channels that axially receive the main power conductor and the tap conductor, respectively, and the connector halves are bolted to one another to clamp the metal connector pieces to the conductors. Such bolt-on connectors have been widely accepted in the industry primarily due to their ease of installation, but such connectors are not without disadvantages. For example, proper installation of such connectors is often dependent upon predetermined torque requirements of the bolt connection to achieve adequate connectivity of the main and tap conductors. Applied torque in tightening the bolted connection generates tensile force in the bolt that, in turn, creates normal force on the conductors between the connector halves. Applicable torque requirements, however, may or may not be actually achieved in the field and even if the bolt is properly tightened to the proper torque requirements initially, over time, and because of relative movement of the conductors relative to the connector pieces or compressible deformation of the cables and/or the connector pieces over time, the effective clamping force may be considerably reduced. Additionally, the force produced in the bolt is dependent upon frictional forces in the threads of the bolt, which may vary considerably and lead to inconsistent application of force among different connectors.

Compression connectors, instead of utilizing separate connector pieces, may include a single metal piece connector that is bent or deformed around the main power conductor and the tap conductor to clamp them to one another. Such compression connectors are generally available at a lower cost than bolt-on connectors, but are more difficult to install. Hand tools are often utilized to bend the connector around the cables, and because the quality of the connection is dependent upon the relative strength and skill of the installer, widely varying quality of connections may result. Poorly installed or improperly installed compression connectors can present reliability issues in power distribution systems.

Wedge connectors are also known that include a C-shaped channel member that hooks over the main power conductor and the tap conductor, and a wedge member having channels in its opposing sides is driven through the C-shaped member, deflecting the ends of the C-shaped member and clamping the conductors between the channels in the wedge member and the ends of the C-shaped member. One such wedge connector is commercially available from Tyco Electronics Corporation of Harrisburg, Pa. and is known as an AMPACT Tap or Stirrup Connector. AMPACT connectors, however, tend to be more expensive than either bolt-on or compression connectors, and special application tooling, using explosive cartridges packed with gunpowder, has been developed to drive the wedge member into the C-shaped member. Different connectors and tools are available for various sizes of conductors in the field.

AMPACT connectors are believed to provide superior performance over bolt-on and compression connectors. For example, the AMPACT connector results in a wiping contact surface that, unlike bolt-on and compression connectors, is stable, repeatable, and consistently applied to the conductors, and the quality of the mechanical and electrical connection is not as dependent on torque requirements and/or relative skill of the installer. Additionally, and unlike bolt-on or compression connectors, because of the deflection of the ends of the C-shaped member some elastic range is present wherein the ends of the C-shaped member may spring back and compensate for relative compressible deformation or movement of the conductors with respect to the wedge and/or the C-shaped member.

Another problem with known utility line connectors is that individual strands making up the conductor can shift around and cause gaps to appear between the strands when the utility line connectors are assembled to the conductors. For example, the sliding action of the connectors with respect to the conductors may cause strand gaps to appear. Additionally, the compression of the strands may cause the strands to shift position relative to one another. Strand gaps that are wider than the diameter of the individual strands are noticeable and can limit acceptance by a lineman due to the appearance of damaging the conductor.

A need remains for a lower cost, more universally applicable alternative to conventional wedge connectors that provides superior connection performance to bolt-on and compression connectors. A need remains for connectors that limit strand gaps.

BRIEF DESCRIPTION OF THE INVENTION

In one embodiment, an electrical connector assembly is provided including a first conductive member and a second conductive member. The first conductive member includes a first channel portion extending from a first wedge portion, with the first channel portion configured to receive a first conductor therein. The first conductive member includes a jaw movably coupled to the first channel portion and being positioned between the first channel portion and the first wedge portion. The second conductive member includes a second channel portion extending from a second wedge portion where the second channel portion configured to receive a second conductor. The first wedge portion and the second wedge portion are assembled such that the second wedge portion engages the jaw and moves the jaw to the closed position. The jaw engages the first conductor in the closed position. Optionally, the first channel portion may have a contoured shape.

In another embodiment, an electrical connector assembly is provided that includes a first conductive member and a second conductive member. The first conductive member has a first channel portion extending from a first wedge portion, where the first channel portion includes a first cradle configured to receive a first conductor therein. The first cradle includes a first conductor engagement surface engaging the first conductor, where the first conductor engagement surface has a contoured shape. The second conductive member includes a second channel portion extending from a second wedge portion, where the second channel portion configured to receive a second conductor. The first wedge portion and the second wedge portion are adapted to co-nest with one another and be secured to one another once fully mated. The second wedge member forces the first conductor into the first cradle as the first and second wedge members are mated.

DETAILED DESCRIPTION OF THE INVENTION

Figure 10:
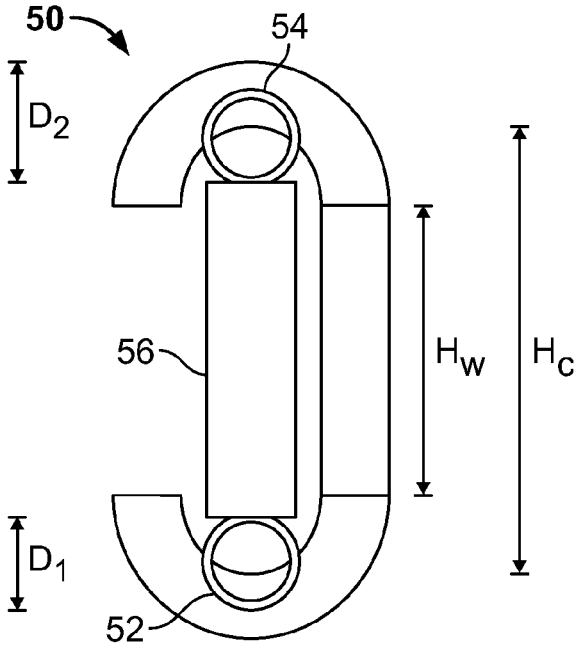
FIG. 10 (Prior Art)
FIG. 10 is a side elevational view of a known wedge connector assembly.
Figure 11:
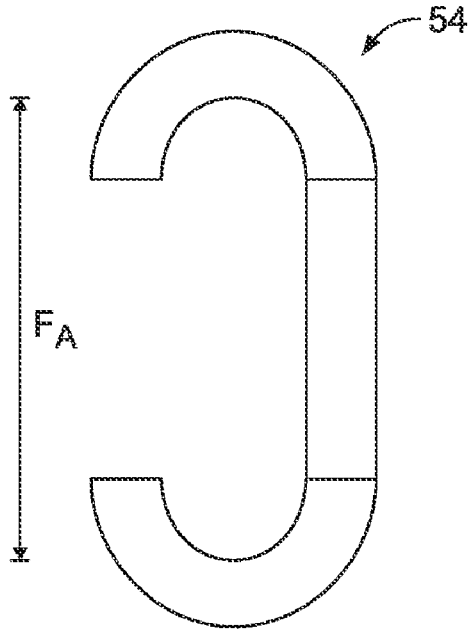
FIG. 11 (Prior Art)
FIG. 11 is a side elevational view of a portion of the assembly shown in FIG. 10.

FIGS. 10 and 11 illustrate a known wedge connector assembly 50 for power utility applications wherein mechanical and electrical connections between a tap or distribution conductor 52 and a main power conductor 55 are to be established. The connector assembly 50 includes a C-shaped member 54 and a wedge member 56. The C-shaped member hooks over the main power conductor 55 and the tap conductor 52, and the wedge member 56 is driven through the C-shaped member 54 to clamp the conductors 52, 55 between the ends of the wedge member 56 and the ends of the C-shaped member 54.

The wedge member 56 may be installed with special tooling having for example, gunpowder packed cartridges, and as the wedge member 56 is forced into the C-shaped member 54, the ends of the C-shaped member are deflected outwardly and away from one another via the applied force $F_A$ shown in FIG. 11. As shown in FIG. 10, the wedge member 56 has a height $H_W$, while the C-shaped member 54 has an height $H_C$ between opposing ends of the C-shaped member where the conductors 52, 55 are received. The tap conductor 52 has a first diameter $D_1$ and the main conductor 55 has a second diameter $D_2$ that may be the same or different from $D_1$. As is evident from FIG. 11, $H_W$ and $H_C$ are selected to produce an interference at each end of the C-shaped member 54 and the respective conductor 52, 55. Specifically, the interference I is established by the relationship:

$$I=H_W+D_1+D_2-H_C \tag{1}$$

With strategic selection of $H_W$ and $H_C$ the actual interference I achieved may be varied for different diameters $D_1$ and $D_2$ of the conductors 52 and 55. Alternatively, $H_W$ and $H_C$ may be selected to produce a desired amount of interference I for various diameters $D_1$ and $D_2$ of the conductors 52 and 55. Consistent generation of at least a minimum amount of interference I results in a consistent application of applied force $F_A$ which will now be explained in relation to FIG. 12.

Figure 12:
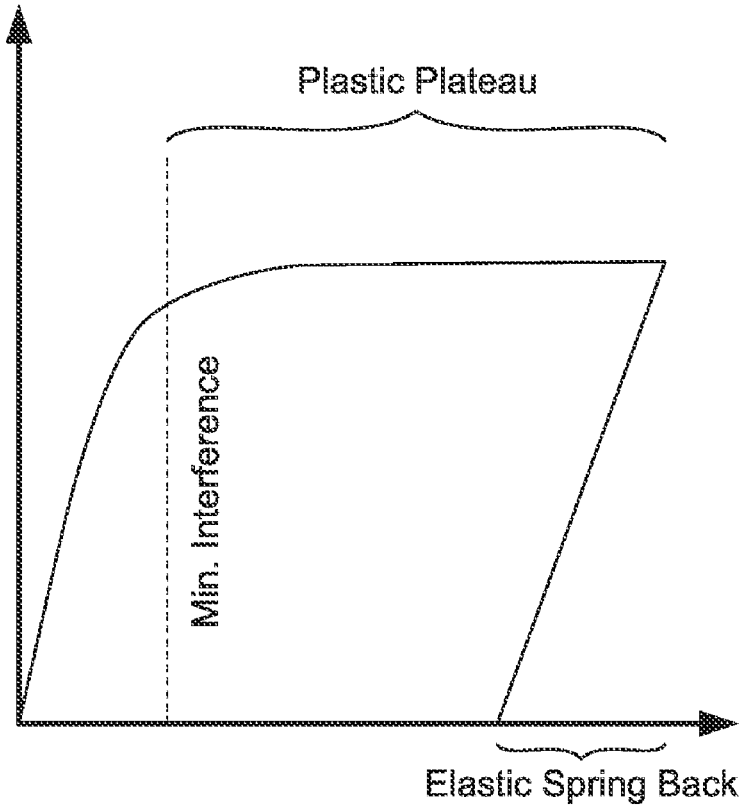
FIG. 12 is a force/displacement graph for the assembly shown in FIG. 10.

FIG. 12 illustrates an exemplary force versus displacement curve for the assembly 50 shown in FIG. 10. The vertical axis represents the applied force, Fa, and the horizontal axis represents displacement of the ends of the C-shaped member 54 as the wedge member 56 is driven into engagement with the conductors 52, 55 and the C-shaped member 54. As FIG. 12 demonstrates, certain amount of interference I, indicated in FIG. 12 with a vertical dashed line, results in plastic deformation of the C-shaped member 54 that, in turn, provides a consistent clamping force on the conductors 52 and 55, indicated by plastic plateau in FIG. 12. The plastic and elastic behavior of the C-shaped member 54 is believed to provide a repeatability in clamping force on the conductors that is not possible with known bolt-on connectors or compression connectors. A need for specialized application tooling for such a connector assembly 50, together with an inventory of differently sized C-shaped members 54 and wedge members 56, renders the connector assembly 50 more expensive and less convenient than some user's desire.

Figure 1:
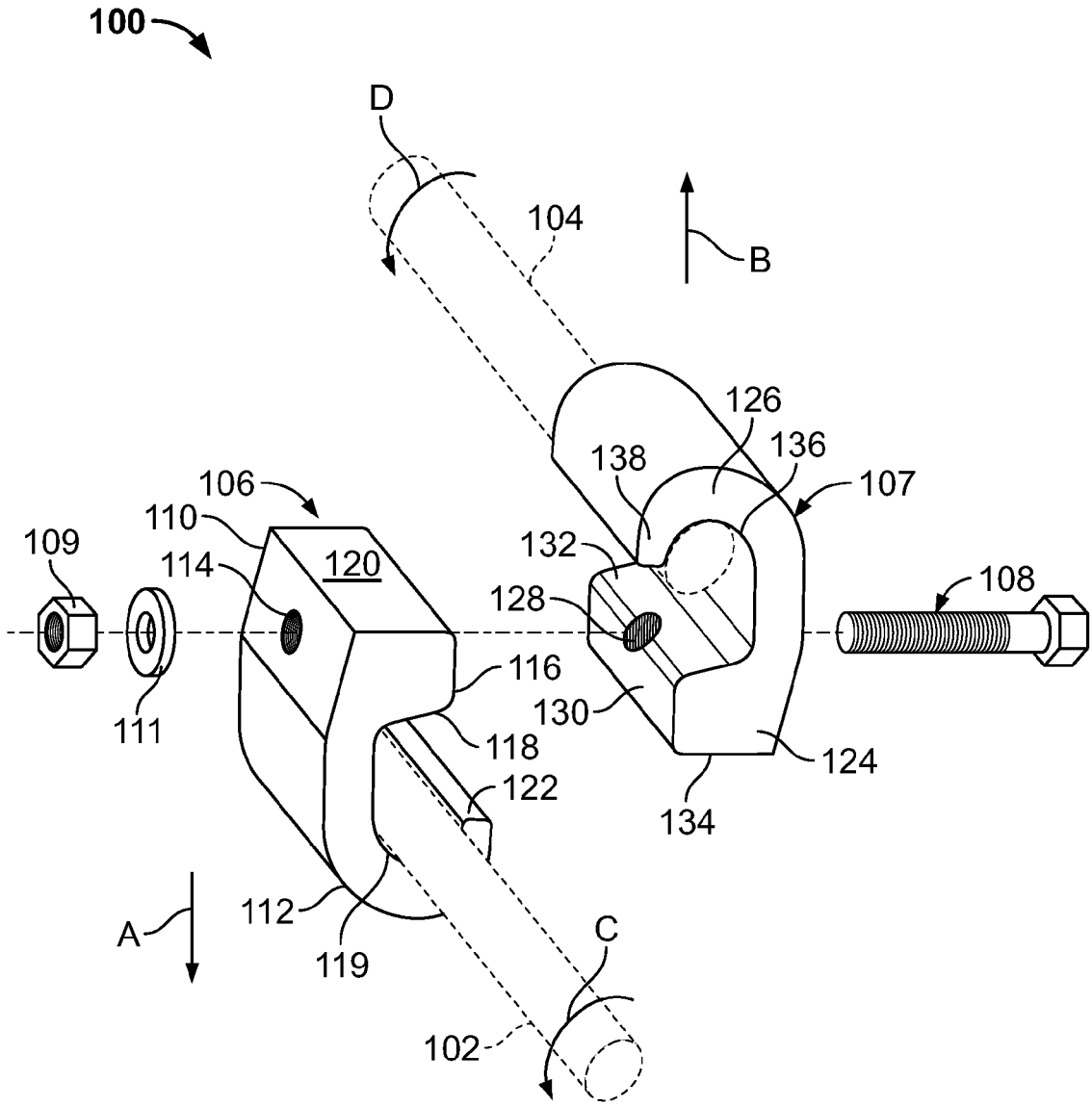
FIG. 1 is an exploded view of a connector assembly formed in accordance with an exemplary embodiment.

FIG. 1 is an exploded view of a connector assembly 100 formed in accordance with an exemplary embodiment of the invention and that overcomes these and other disadvantages. The connector assembly 100 is adapted for use as a tap connector for connecting a tap conductor 102 (shown in phantom in FIG. 1), to a main conductor 104 (also shown in FIG. 1) of a utility power distribution system. As explained in detail below, the connector assembly 100 provides superior performance and reliability to known bolt-on and compression connectors, while providing ease of installation and lower cost relative to known wedge connector systems.

The tap conductor 102, sometimes referred to as a distribution conductor, may be a known high voltage cable or line having a generally cylindrical form in an exemplary embodiment. The main conductor 104 may also be a generally cylindrical high voltage cable line. The tap conductor 102 and the main conductor 104 may be of the same wire gage or different wire gage in different applications and the connector assembly 100 is adapted to accommodate a range of wire gages for each of the tap conductor 102 and the main conductor 104. The main conductor 104 and the tap conductor 102 may be assembled from multiple strands of cable that are bundled together. The strands are twisted around one another to form the bundle. The strands may spread apart when the connector assembly 100 is connected to the conductors 102, 104 forming strand gaps between adjacent strands.

When installed to the tap conductor 102 and the main conductor 104, the connector assembly 100 provides electrical connectivity between the main conductor 104 and the tap conductor 102 to feed electrical power from the main conductor 104 to the tap conductor 102 in, for example, an electrical utility power distribution system. The power distribution system may include a number of main conductors 104 of the same or different wire gage, and a number of tap conductors 102 of the same or different wire gage. The connector assembly 100 may be used to provide tap connections between main conductors 104 and tap conductors 102 in the manner explained below.

As shown in FIG. 1, the connector assembly 100 includes a tap conductive member 106, a main conductive member 107, and a fastener 108 that couples the tap conductive member 106 and the main conductive member 107 to one another. In an exemplary embodiment, the fastener 108 is a threaded member inserted through the respective conductive members 106 and 107, and a nut 109 and lock washer 111 are provided to engage an end of the fastener 108 when the conductive members 106 and 107 are assembled. In one embodiment, an inner diameter of the fastener bore 114 is larger than an outer diameter of the fastener 108, thereby providing some relative freedom of movement of the fastener 108 with respect to the fastener bore 114. While specific fastener elements 108, 109 and 111 are illustrated in FIG. 1, it is understood that other known fasteners may alternatively be used if desired.

The tap conductive member 106 includes a wedge portion 110 and a channel portion 112 extending from the wedge portion 110. A fastener bore 114 is formed in and extends through the wedge portion 110, and the wedge portion 110 further includes an abutment face 116, a wiping contact surface 118 angled with respect to the abutment face 116, and a conductor contact surface 120 extending substantially perpendicular to the abutment face 116 and obliquely with respect to the wiping contact surface 118. The wiping contact surface 118 and the conductor contact surface 120 are angled with respect to one another at a wedge angle. As such, the wiping contact surface 118 and the conductor contact surface 120 together define a wedge structure having an inclined plane for transferring motion during assembly.

The channel portion 112 extends away from the wedge portion 110 and forms a channel or cradle 119 adapted to receive the tap conductor 102 at a spaced relation from the wedge portion 110. A distal end 122 of the channel portion 112 includes a radial bend that wraps around the tap conductor 102 for about 180 circumferential degrees in an exemplary embodiment, such that the distal end 122 faces toward the wedge portion 110, and the wedge portion 110 overhangs the channel or cradle 119. A space is created between the wedge portion 110 and the channel portion 112 that receives the main conductive member 107. The channel portion 112 is reminiscent of a hook in one embodiment, and the wedge portion 110 and the channel portion 112 together resemble the shape of an inverted question mark. The tap conductive member 106 may be integrally formed and fabricated from extruded metal, together with the wedge and channel portions 110, 112 in a relatively straightforward and low cost manner.

The main conductive member 107 likewise includes a wedge portion 124 and a channel portion 126 extending from the wedge portion 124. A fastener bore 128 is formed in and extends through the wedge portion 124, and the wedge portion 124 further includes an abutment face 130, a wiping contact surface 132 angled with respect to the abutment face 130, and a conductor contact surface 134 extending substantially perpendicular to the abutment face 130 and obliquely with respect to the wiping contact surface 132. The wiping contact surface 132 and the conductor contact surface 134 are angled with respect to one another at a wedge angle. As such, the wiping contact surface 132 and the conductor contact surface 134 together define a wedge structure having an inclined plane for transferring motion during assembly. In one embodiment, an inner diameter of the fastener bore 128 is larger than an outer diameter of the fastener 108, thereby providing some relative freedom of movement of the fastener 108 with respect to the fastener bore 128 as the conductive members 106 and 107 are mated as explained below.

The channel portion 126 extends away from the wedge portion 124 and forms a channel or cradle 136 adapted to receive the main conductor 104 at a spaced relation from the wedge portion 124. A distal end 138 of the channel portion 126 includes a radial bend that wraps around the main conductor 104 for about 180 circumferential degrees in an exemplary embodiment, such that the distal end 138 faces toward the wedge portion 124, and the channel 136 overhangs the wedge portion 124. A space is created between the wedge portion 124 and the channel portion 126 that receives the tap conductive member 106. The channel portion 126 is reminiscent of a hook in one embodiment, and the wedge portion 124 and the channel portion 126 together resemble the shape of a question mark. The main conductive member 107 may be integrally formed and fabricated from extruded metal, together with the wedge and channel portions 124, 126 in a relatively straightforward and low cost manner.

The tap conductive member 106 and the main conductive member 107 are separately fabricated from one another or otherwise formed into discrete connector components and are assembled to one another as explained below. While one exemplary shape of the tap and main conductive members 106, 107 has been described herein, it is recognized that the conductive members 106, 107 may be alternatively shaped in other embodiments as desired.

In one embodiment, the wedge portions 110 and 124 of the respective tap and the main conductive members 106, 107 are substantially identically formed and share the same geometric profile and dimensions to facilitate interfitting of the wedge portions 110 and 124 in the manner explained below as the conductive members 106, 107 are mated. The channel portions 112, 126 of the conductive members 106 and 107, however, may be differently dimensioned as appropriate to be engaged to differently sized conductors 102, 104 while maintaining substantially the same shape of the conductive members 106, 107. Identical formation of the wedge portions 110 and 124 provides for mixing and matching of conductive members 106 and 107 for differently sized conductors 102, 104 while achieving a repeatable and reliable connecting interface via the wedge portions 110 and 124.

As shown in FIG. 1, the tap conductive member 106 and the main conductive member 107 are generally inverted relative to one another with the respective wedge portions 110 and 124 facing one another and the fastener bores 114, 128 aligned with one another to facilitate extension of the fastener 108 therethrough. The channel portion 112 of the tap conductive member 106 extends away from the wedge portion 110 in a first direction, indicated by the arrow A, and the channel portion 126 of the main conductive member 107 extends from the wedge portion 124 in a second direction, indicated by arrow B that is opposite to the direction of arrow A. Additionally, the channel portion 112 of the tap conductive member 106 extends around the tap conductor 102 in a circumferential direction indicated by the arrow C, while the channel portion 126 of the main conductive member 107 extends circumferentially around the main conductor 104 in the direction of arrow D that is opposite to arrow C.

Figure 2:
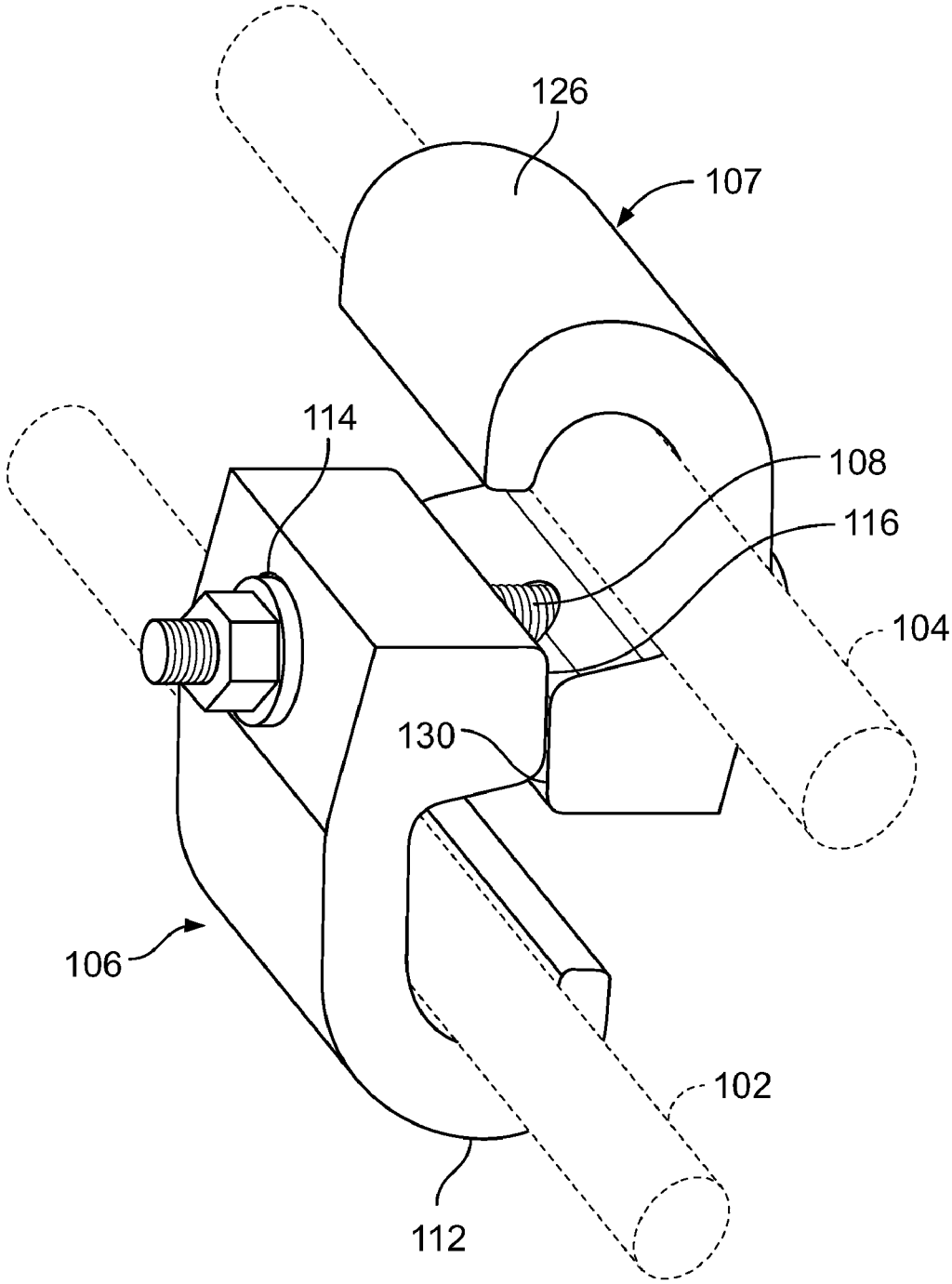
FIG. 2 is a perspective view of the assembly shown in FIG. 1 in an unmated position.
Figure 3:
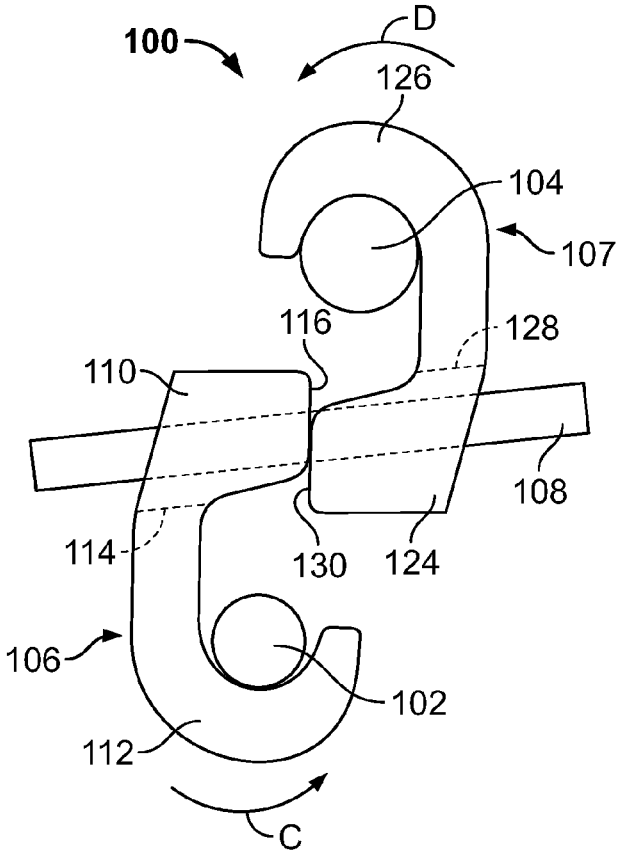
FIG. 3 is a side elevational view of the assembly shown in FIG. 2 in a fully opened or unmated position.

When the channel portions 112, 126 are hooked over the respective conductors 102, 104 and the when the conductive member 106, 107 are coupled together by the fastener elements 108, 109, 111, the abutment faces 116, 130 are aligned in an unmated condition as shown in perspective view in FIG. 2, and in side elevational view in FIG. 3. The connector assembly 100 may be preassembled into the configuration shown in FIGS. 2 and 3, and hooked over the conductors 102 and 104 in the directions of arrows C and D relatively easily. As seen in FIG. 3, and because the inner diameters of the fastener bores 114, 128 (shown in phantom in FIG. 3) are larger than an outer diameter of the fastener 108, the fastener 108 is positionable in a first angular orientation through the wedge portions 110 and 124.

Figure 4:
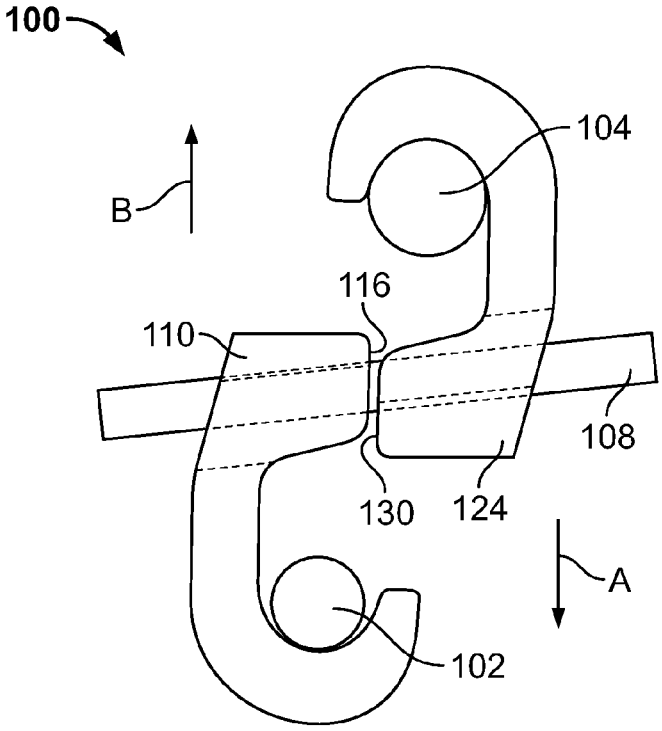
FIG. 4 is another side elevational view of the assembly shown in FIG. 2 in a first intermediate position.
Figure 5:
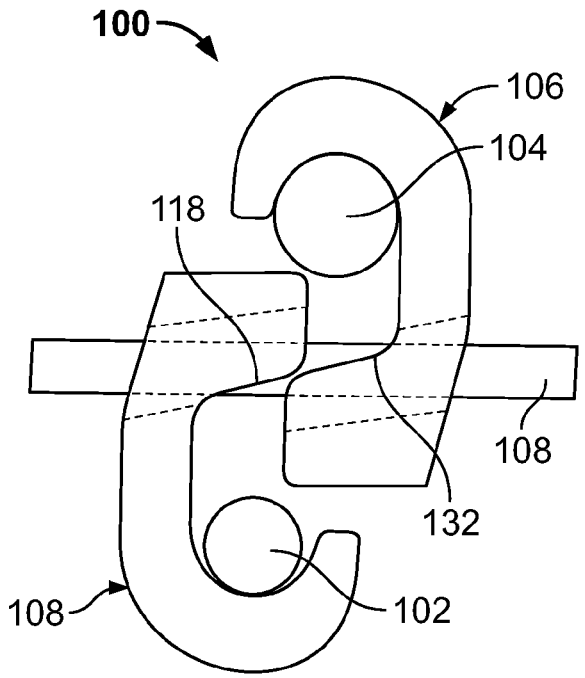
FIG. 5 is a side elevational view of the assembly shown in FIG. 2 in a second intermediate position.
Figure 6:
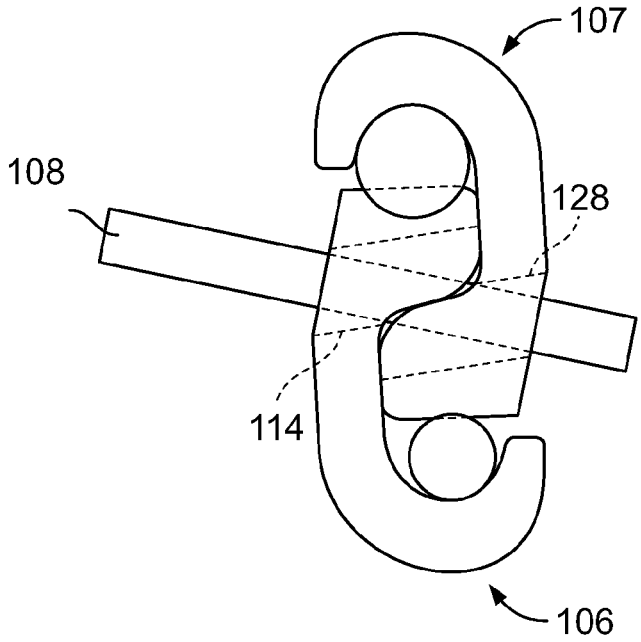
FIG. 6 is a side elevational view of the assembly shown in FIG. 2 in a fully closed or mated position.

As illustrated in FIGS. 4-6, the larger diameter of the fastener bores 114, 128 relative to the fastener 108 permits the fastener 108 to float or move angularly with respect to an axis of the bores 114, 128 as the conductive members 106, 107 are moved to a fully mated position. More particularly, the abutment faces 116, 130 of the wedge portions 110, 124 are moved in sliding contact with one another in the directions of arrows A and B as shown in FIG. 4 until the wiping contact surfaces 118, 132 are brought into engagement as shown in FIG. 5, and the wedge portions 110, 124 may then be moved transversely into a nested or interfitted relationship as shown in FIG. 6 with the wiping contact surfaces 118, 132 in sliding engagement. All the while, and as demonstrated in FIGS. 4-6, the fastener 108 self adjusts its angular position with respect to the fastener bores as the fastener 108 moves from the initial position shown in FIG. 3 to a final position shown in FIG. 6. In the final position shown in FIG. 6, the fastener 108 extends obliquely to each of the fastener bores 114, 128, and the nut 109 may be tightened to the fastener 108 to secure the conductive members 106, 107 to one another.

Figure 7:
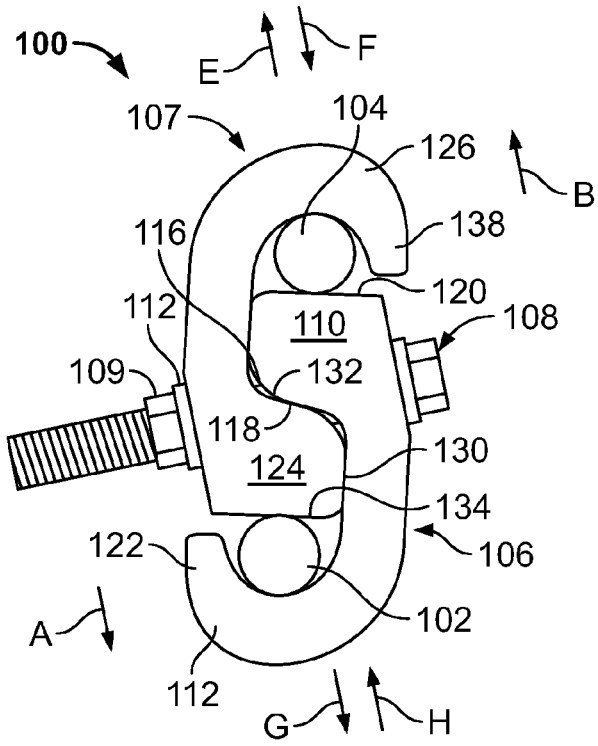
FIG. 7 is another side elevational view of the assembly shown in FIG. 2 in the mated condition.

FIG. 7 illustrates the connector assembly 100 in a fully mated position with the nut 109 tightened to the fastener 108. As the conductive members 106, 107 are moved through the positions shown in FIGS. 4-6, the wiping contact surfaces 118, 132 slidably engage one another and provide a wiping contact interface that ensures adequate electrically connectivity. The angled wiping contact surfaces 118, 132 provide a ramped contact interface that displaces the conductor contact surfaces 120, 134 in opposite directions indicated by arrows A and B as the wiping contact surfaces 118, 132 are engaged. The wedge shape provided by the angled wiping contact surfaces 118, 134 transfer motion of the conductive members 106, 107 in a generally horizontal direction to motion in a generally vertical direction by the wedge action taking place at the interface of the conductive members 106, 107. In addition, the conductor contact surfaces 120, 134 provide wiping contact interfaces with the conductors 102 and 104 as the connector assembly 100 is installed.

Movement of the conductor contact surfaces 120, 134 in the opposite directions of arrows A and B clamps the conductors 102 and 104 between the wedge portions 110 and 124, and the opposing channel portions 112, 126. The distal ends 122, 138 of the channel portions 112, 126 are brought adjacent to the wedge portions 110, 124 to the mated position shown in FIGS. 6 and 7, thereby substantially enclosing portions of the conductors 102, 104 within the connector assembly 100. Eventually, the abutment faces 116, 130 of the wedge portions 110, 124 contact the channel portions 126, 112 of the opposing conductive members 107 and 106, and the connector assembly 100 is fully mated. In such a position, the wedge portions 110, 124 are nested or mated with one another in an intermitting relationship with the wiping contact surfaces 118 and 132, the abutment faces 116 and 130, and the channel portions 112 and 126 providing multiple points of mechanical and electrical contact to ensure electrical connectivity between the conductive members 106 and 107.

In the fully mated position shown in FIGS. 6 and 7, the main conductor 104 is captured between the channel portion 126 of the main conductive member 107 and the conductor contact surface 120 of the tap conductive member wedge portion 110. Likewise, the tap conductor 102 is captured between the channel portion 112 of the tap conductive member 106 and the conductor contact surface 134 of the main conductive member wedge portion 124. As the wedge portion 110 engages the tap conductive member 106 and clamps the main conductor 104 against the channel portion 126 of the main conductive member 107 the channel portion 126 is deflected in the direction of Arrow E. The channel portion 126 is elastically and plastically deflected in a radial direction indicated by arrow E, resulting in a spring back force in the direction of Arrow F, opposite to the direction of arrow E to provide a clamping force on the conductor. A large contact force, on the order of about 4000 lbs is provided in an exemplary embodiment, and the clamping force ensures adequate electrical connectivity between the main conductor 104 and the connector assembly 100. Additionally, elastic spring back of the channel portion 126 provides some tolerance for deformation or compressibility of the main conductor 104 over time, because the channel portion 126 may effectively return in the direction of arrow F if the main conductor 104 deforms due to compression forces. Actual clamping forces may be lessened in such a condition, but not to such a mount as to compromise the integrity of the electrical connection.

When fully mated, the abutment faces 116 and 130 engage the channel portions 126 and 112 to form a displacement stop that defines and limits a final displacement relation between the tap and main conductive members 106 and 107. The displacement stop defines a final mating position between the tap and main conductive members 106 and 107 independent of an amount of force induced upon the main and tap conductors 104 and 102 by the main and tap conductive members 107 and 106.

Optionally, the displacement stop may be created from a stand off provided on one or both of the main and tap conductive members 107 and 106. For example, the stand off may be positioned proximate the fastener bore 128 and extend outward therefrom. Alternatively, the stand off may be created as mating notches provided in the wiping contact surfaces 118 and 132, where the notches engage one another to limit a range of travel of the main and tap conductive members 107 and 106 toward one another.

Likewise, the wedge portion 124 of the main conductive member 107 clamps the tap conductor 102 against the channel portion 112 of tap conductive member 106 and the channel portion 112 is deflected in the direction of arrow G. The channel portion 112 is elastically and plastically deflected in a radial direction indicated by arrow G, resulting in a spring back force in the direction of Arrow H opposite to the direction of arrow G. A large contact force, on the order of about 4000 lbs is provided in an exemplary embodiment, and the clamping force ensures adequate electrical connectivity between the tap conductor 102 and the connector assembly 100. Additionally, elastic spring back of the channel portion 112 provides some tolerance for deformation or compressibility of the tap conductor 102 over time, because the channel portion 112 may simply return in the direction of arrow H if the tap conductor 102 deforms due to compression forces. Actual clamping forces may be lessened in such a condition, but not to such a mount as to compromise the integrity of the electrical connection.

Unlike known bolt connectors, torque requirements for tightening of the fastener 108 are not required to satisfactorily install the connector assembly 100. When the abutment faces 116, 130 of the wedge portions 110, 124 contact the channel portions 126 and 112, the connector assembly 100 is fully mated. By virtue of the fastener elements 108 and 109 and the combined wedge action of the wedge portions 110, 124 to deflect the channel portions 112 and 126, the connector assembly 100 may be installed with hand tools, and specialized tooling, such as the explosive cartridge tooling of the AMPACT Connector system is avoided.

The displacement stop allows the nut 109 and fastener 108 to be continuously tightened until the abutment faces 116 and 130 fully seat against the channel portions 126 and 112, independent of, and without regard for, any normal forces created by the tap and main conductors 102 and 104. The contact forces are created by interference between the channel portions 126, 112, and wedge portions 110, 124, and tap and main conductors 102 and 104. The bolt torque in not referenced in the mating the connector assemble 100. Instead, the assembly 100 is fully mated when the main and tap conductive members 106 and 107 are joined to a predetermined position or relative displacement. In the fully mated condition, the interference between the conductors 102 and 104 and the connector assembly 100 produces a contact force adequate to provide a good electrical connection.

It is recognized that effective clamping force on the conductors is dependent upon the geometry of the wedge portions, dimensions of the channel portions, and size of the conductors used with the connector assembly 100. Thus, with strategic selections of angles for the wiping contact surfaces 118, 130 for example, and the radius and thickness of the curved distal ends 122 and 138 of the conductive members, varying degrees of clamping force may be realized when the conductive members 106 and 107 are used in combination as described above.

Figure 8:
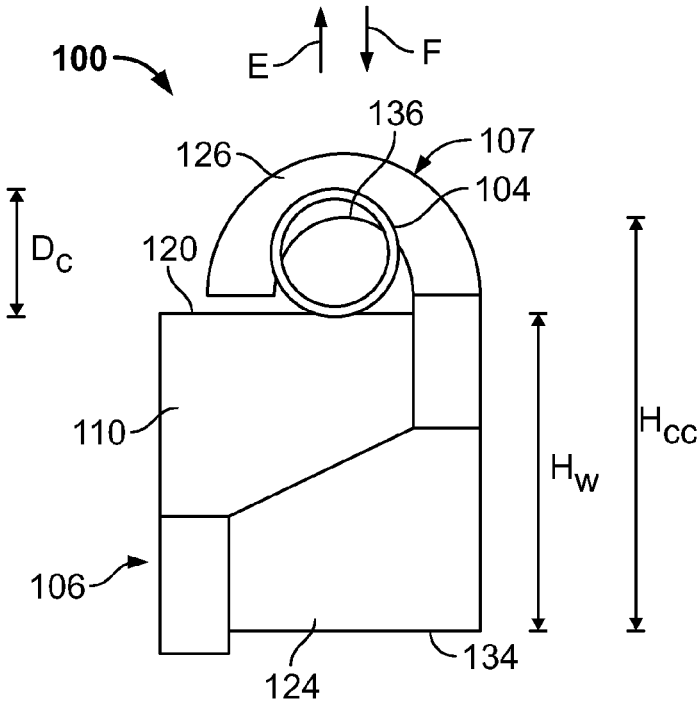
FIG. 8 is a schematic side view of a portion of the assembly shown in FIG. 2.

FIG. 8 illustrates an interference created in the connector assembly 100 that produces the deflection and spring back in the connectors. While the interference will be explained only in reference to the upper portion of the connector assembly 100, it is understood that the lower portion of the assembly operates in a similar manner. As shown in FIG. 8, the wedge portion 110 of the tap conductive member 106 and the wedge portion 124 of the main conductive member 107 are fully engaged. A wedge height $H_W$ extends between the conductor contact surfaces 120, 124 of the respective wedge portions 110, 124, and a clearance height $H_{CL}$ extends between the conductor contact surface 134 of the wedge 124 and the inner surface 136 of the main conductive member channel portion 126. The main conductor 104, however, has a diameter $D_C$ prior to installation of the connector. An interference I is therefore created according to the following relationship:

$$I=H_W+D_C-H_{CL} \quad (2)$$

By strategically selecting $H_W$ and $H_{CL}$, repeatable and reliable performance may be provided in a similar manner as explained above in relation to FIG. 12, namely via elastic and plastic deformation of the conductive members, while eliminating a need for special tooling to assemble the connector.

Because of the deflectable channel portions 112, 126 in discrete connector components, the conductive members 106 and 107 may accommodate a greater range of conductor sizes or gages in comparison to conventional wedge connectors. Additionally, even if several versions of the conductive members 106 and 107 are provided for installation to different conductor wire sizes or gages, the assembly 100 requires a smaller inventory of parts in comparison to conventional wedge connector systems, for example, to accommodate a full range of installations in the field. That is, a relatively small family of connector parts having similarly sized and shaped wedge portions may effectively replace a much larger family of parts known to conventional wedge connector systems.

It is therefore believed that the connector assembly 100 provides the performance of conventional wedge connector systems in a lower cost connector assembly that does not require specialized tooling and a large inventory of parts to meet installation needs. Using low cost extrusion fabrication processes and known fasteners, the connector assembly 100 may be provided at low cost, while providing increased repeatability and reliability as the connector assembly 100 is installed and used. The combination wedge action of the conductive members 106 and 107 provides a reliable and consistent clamping force on the conductors 102 and 104 and is less subject to variability of clamping force when installed than either of known bolt-on or compression-type connector systems.

Figure 9:
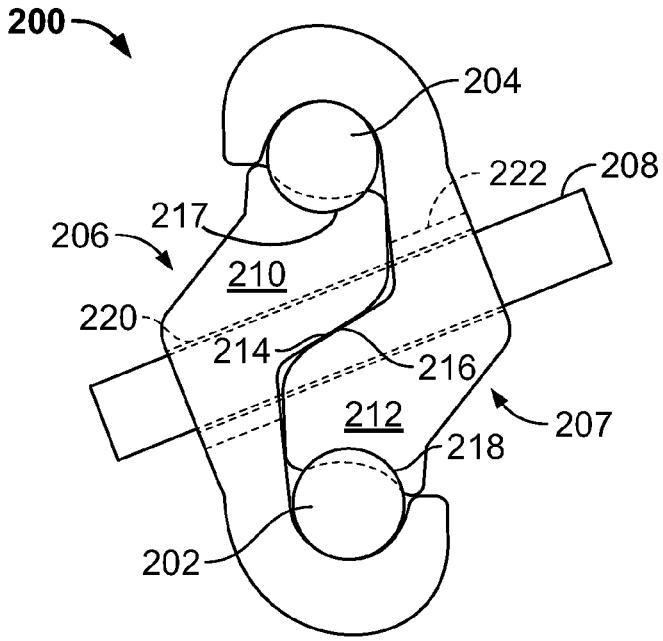
FIG. 9 is a side elevational view of another embodiment of a connector assembly formed in accordance with an exemplary embodiment.

FIG. 9 illustrates another embodiment of a connector assembly 200 that is constructed and operates in a similar manner to the assembly 100. Like the assembly 100, the assembly 200 includes a tap conductor 202, a main conductor 204, a tap conductive member 206, a main conductive member 207, and a fastener 208.

Each of the conductive members 206 and 207 are formed with respective wedge portions 210 and 212, and each of the wedge portions 210 and 212 defines a wiping contact surface 214, 216 and a conductor contact surface 217, 218. Optionally, and as shown in FIG. 9, the conductor contact surfaces 217, 218 are rounded. The conductor contact surfaces 217, 218 are rounded to capture the conductors 202, 204 therein. The conductor contact surfaces 217, 218 help hold the strands of the conductors 202, 204 together and in position relative to one another to reduce strand gaps between adjacent strands. In the illustrated embodiment, the conductor contact surfaces 217, 218 have a radius of curvature that differs from a radius of curvature of the channel portions. Also, the geometry of the wedge portions 210, 212 are such that the ends of the wedge portions defining the conductor contact surfaces 217, 218 are angled with respect to the channel portions of the conductive members 206, 207.

Additionally, in the assembly 200, the wedge portions 210 and 212 are geometrically shaped so that fastener bores 220, 222 formed through the respective wedges more readily align with the fastener 208 than in the connector assembly 100, thereby reducing, if not limiting, the tendency of the fastener 208 to float and pivot relative to the conductive members 206, 207 as the assembly 200 is installed to the conductors. This construction is believed to permit complete engagement of the conductive members 206, 207 with a reduced amount of force applied to the fastener 208.

Figure 13:
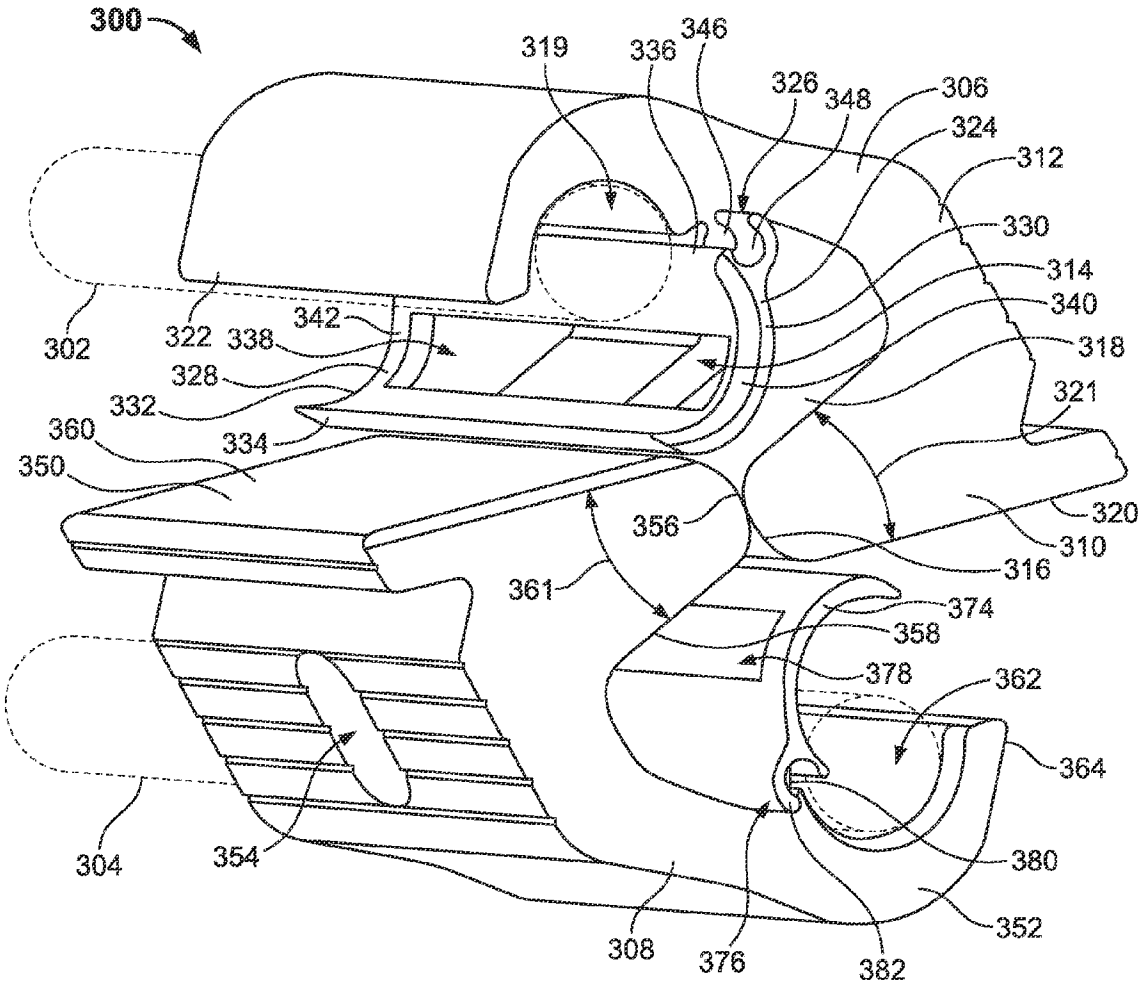
FIG. 13 is a perspective view of an alternative connector assembly formed in accordance with an exemplary embodiment.

FIG. 13 is a perspective view of an alternative connector assembly 300 that is constructed and operates in a similar manner to the assembly 100. Like the assembly 100, the assembly 300 includes a tap conductor 302, a main conductor 304, a tap conductive member 306 and a main conductive member 308. The tap conductive member 306 and the main conductive member 308 are configured to be connected to one another using a fastener (not shown) similar to the fastener used to assemble the connector 100.

The tap conductive member 306 includes a wedge portion 310 and a channel portion 312 extending from the wedge portion 310. A fastener bore 314 is formed in and extends through the wedge portion 310. The wedge portion 310 further includes an abutment face 316, an inner surface 318, and an outer surface 320 that faces the main conductor 304. The inner surface 318 defines a wiping contact surface that is configured to wipe against a corresponding surface of the main conductive member 308 during assembly in a sliding action, which serves to clean the surfaces by removing contamination and/or oxidation to ensure good electrical contact between the two surfaces. The inner surface 318 is angled with respect to the outer surface 320 at a wedge angle 321. The outer surface 320 may extend substantially perpendicular to the abutment face 316 and obliquely with respect to the inner surface 318. As such, the inner surface 318 and the outer surface 320 together define a wedge structure having an inclined plane for transferring motion during assembly.

The channel portion 312 extends away from the wedge portion 310 and forms a channel or cradle 319 adapted to receive the tap conductor 302 at a spaced relation from the wedge portion 310. A distal end 322 of the channel portion 312 includes a radial bend that wraps around the tap conductor 302 for about 180 circumferential degrees in an exemplary embodiment, such that the distal end 322 faces toward the wedge portion 310, and the wedge portion 310 overhangs the channel or cradle 319. A space is created between the wedge portion 310 and the channel portion 312 that receives the main conductive member 308. The channel portion 312 is reminiscent of a hook in one embodiment. The tap conductive member 306 may be integrally formed and fabricated from extruded metal, together with the wedge and channel portions 310, 312 in a relatively straightforward and low cost manner.

The tap conductive member 306 includes a jaw 324 movably coupled to the channel portion 312. The jaw 324 is positioned within the space between the channel portion 312 and the wedge portion 310. In an exemplary embodiment, the jaw 324 is pivotably coupled to the channel portion 312 at a hinge 326. The jaw 324 is movable between an open position, such as the position shown in FIG. 13, and a closed position. In the open position, the jaw 324 provides access to the cradle 319 such that the cradle 319 is able to receive the tap conductor 302. As the jaw 324 is moved to the closed position, the jaw 324 is moved relatively closer to the tap conductor 302. The jaw 324 closes around the tap conductor 302. In the closed position, the jaw 324 and the cradle 319 cooperate to substantially circumferentially surround the tap conductor 302.

The jaw 324 includes a curved seat 328 configured to receive the conductor 302. The curved seat 328 and the cradle 319 have similar radii of curvature, which are similar to the radius of curvature of the tap conductor 302. The jaw 324 extends along a length between a first end 330 and a second end 332. Optionally, the jaw 324 may be longer than the wedge portion 310 and the channel portion 312 such that the ends 330, 332 of the jaw 324 extend beyond the wedge portion 310 and the channel portion 312. The jaw 324 also extends between a first edge 334 and a second edge 336. The curved seat 328 is curved between the first and second edges 334, 336. The hinge 326 is provided at the second edge 336.

The jaw 324 includes a window 338 therethrough. The window 338 is elongated between the first and second ends 330, 332. Optionally, the window 338 may be approximately the same length as the wedge portion 310 and the channel portion 312. Webs 340, 342 are provided between ends of the window 338 and the first and second ends 330, 332, respectively. When the jaw 324 is closed, the webs 340, 342 are positioned axially beyond the ends of the wedge portion 310 and the channel portion 312. When the jaw 324 is closed, the window 338 is positioned radially inward of the tap conductor 302.

In an exemplary embodiment, the jaw 324 is pivoted about the hinge 326. The hinge 326 includes a pin 346 extending from the channel portion 312 and a socket 348 at an end of the jaw 324. The pin 346 is received in the socket 348. The hinge 326 limits motion to rotating movement. Alternative coupling means may be provided in alternative embodiments to secure the jaw 324 to the channel portion 312. The jaw 324 may have a different range of motion in alternative embodiments, depending on the type of coupling means.

The main conductive member 308 likewise includes a wedge portion 350 and a channel portion 352 extending from the wedge portion 350. A fastener bore 354 is formed in and extends through the wedge portion 350, and the wedge portion 350 further includes an abutment face 356, an inner surface 358 angled with respect to the abutment face 356, and an outer surface 360 that faces the tap conductor 302. The inner surface 358 defines a wiping contact surface that is configured to wipe against the inner surface 318 during assembly in a sliding action. The inner surface 358 is angled with respect to the outer surface 360 at a wedge angle 361. The outer surface 360 may extend substantially perpendicular to the abutment face 356 and obliquely with respect to the inner surface 358. As such, the inner surface 358 and the outer surface 360 together define a wedge structure having an inclined plane for transferring motion during assembly.

The channel portion 352 extends away from the wedge portion 350 and forms a channel or cradle 362 adapted to receive the main conductor 304 at a spaced relation from the wedge portion 350. A distal end 364 of the channel portion 352 includes a radial bend that wraps around the main conductor 304 for about 180 circumferential degrees in an exemplary embodiment, such that the distal end 364 faces toward the wedge portion 350, and the channel 362 overhangs the wedge portion 350. A space is created between the wedge portion 350 and the channel portion 352 that receives the tap conductive member 306. The channel portion 352 is reminiscent of a hook in one embodiment. The main conductive member 308 may be integrally formed and fabricated from extruded metal, together with the wedge and channel portions 350, 352 in a relatively straightforward and low cost manner.

The main conductive member 308 includes a jaw 374 movably coupled to the channel portion 352. The jaw 374 is positioned within the space between the channel portion 352 and the wedge portion 350. In an exemplary embodiment, the jaw 374 is pivotably coupled to the channel portion 352 at a hinge 376. The jaw 374 is movable between an open position, such as the position shown in FIG. 13, and a closed position. In the open position, the jaw 374 provides access to the cradle 362 such that the cradle 362 is able to receive the main conductor 304. As the jaw 374 is moved to the closed position, the jaw 374 is moved relatively closer to the main conductor 304. The jaw 374 closes around the main conductor 304. In the closed position, the jaw 374 and the cradle 362 cooperate to substantially circumferentially surround the tap conductor 302.

The jaw 374 may be substantially similar to the jaw 324. Alternatively, the jaw 374 may be different than the jaw 324. For example, the jaw 374 may have a different radius of curvature or a different length than the jaw 324. The jaw includes a hinge 376 along one edge thereof. The jaw 374 includes a window 378 therethrough. When the jaw 374 is closed, the window 378 is positioned radially inward of the main conductor 304.

In an exemplary embodiment, the jaw 374 is pivoted about the hinge 376. The hinge 376 includes a pin 380 extending from the channel portion 312 and a socket 382 at an end of the jaw 374. The pin 380 is received in the socket 382. The hinge 376 limits motion to rotating movement. Alternative coupling means may be provided in alternative embodiments to secure the jaw 374 to the channel portion 352. The jaw 374 may have a different range of motion in alternative embodiments, depending on the type of coupling means.

The tap conductive member 306 and the main conductive member 308 are separately fabricated from one another or otherwise formed into discrete connector components and are assembled to one another as explained below. While one exemplary shape of the tap and main conductive members 306, 308 has been described herein, it is recognized that the conductive members 306, 308 may be alternatively shaped in other embodiments as desired.

In one embodiment, the wedge portions 310 and 350 of the respective tap and the main conductive members 306, 308 are substantially identically formed and share the same geometric profile and dimensions to facilitate interfitting of the wedge portions 30 and 350 in the manner explained below as the conductive members 306, 308 are mated. The channel portions 312, 352 of the conductive members 306 and 308, however, may be differently dimensioned as appropriate to be engaged to differently sized conductors 302, 304 while maintaining substantially the same shape of the conductive members 306, 308. Identical formation of the wedge portions 310 and 350 provides for mixing and matching of conductive members 306 and 308 for differently sized conductors 302, 304 while achieving a repeatable and reliable connecting interface via the wedge portions 310 and 350.

As shown in FIG. 13, the tap conductive member 306 and the main conductive member 308 are generally inverted relative to one another with the respective wedge portions 310 and 350 facing one another and the fastener bores 314, 354 aligned with one another to facilitate extension of the fastener therethrough. The channel portion 312 of the tap conductive member 306 extends away from the wedge portion 310 in a first direction and the channel portion 352 of the main conductive member 308 extends from the wedge portion 350 in a second direction that is opposite to the first direction.

During assembly, the conductive members 306, 308 are inverted relative to one another. The wedge portion 310 is aligned with the wedge portion 350 proximate the space between the wedge portion 350 and the channel portion 352. The wedge portion 310 is positioned adjacent to the jaw 374. Optionally, the wedge portion 310 may abut the jaw 374. Similarly, the wedge portion 350 is positioned proximate to the space between the wedge portion 310 and the channel portion 312 generally adjacent to the jaw 324. As the conductive members 306, 308 are coupled one another, the outer surfaces 320, 360 are driven away from one another. The outer surface 320 engages the jaw 374 and drives the jaw 374 to the closed position. The outer surface 360 engages the jaw 324 and drives the jaw 324 to the closed position.

In the closed position, the jaws 324, 374 cooperate with the cradles 319, 362 to hold the conductors 302, 304, respectively. The jaws 324, 374 and the cradles 319, 362 substantially circumferentially surround the conductors 302, 304. The jaws 324, 374 and the cradles 319, 362 hold the individual strands of the conductors 302, 304 in position relative to one another and limit the amount of displacement of any given strand to limit unwanted strand gaps from forming. For example, because the radii of curvature of the jaws 324, 374 and the cradles 319, 362 are substantially similar to the radius of curvature of the conductors 302, 304, the relative positions of the individual strands are maintained. In an exemplary embodiment, the jaws 324, 374 and the cradles 319, 362 cooperate to limit strand gaps from being larger than the diameter of the strands.

In the closed position, the wedge portion 310 extends through the window 378 and engages the main conductor 304. As such, the wedge portion 310 is able to make direct physical contact with the main conductor 304 through the window 378. Similarly, the wedge portion 350 extends through the window 338 and engages the tap conductor 302. As such, the wedge portion 350 is able to make direct physical contact with the conductor 302 through the window 338.

Figure 14:
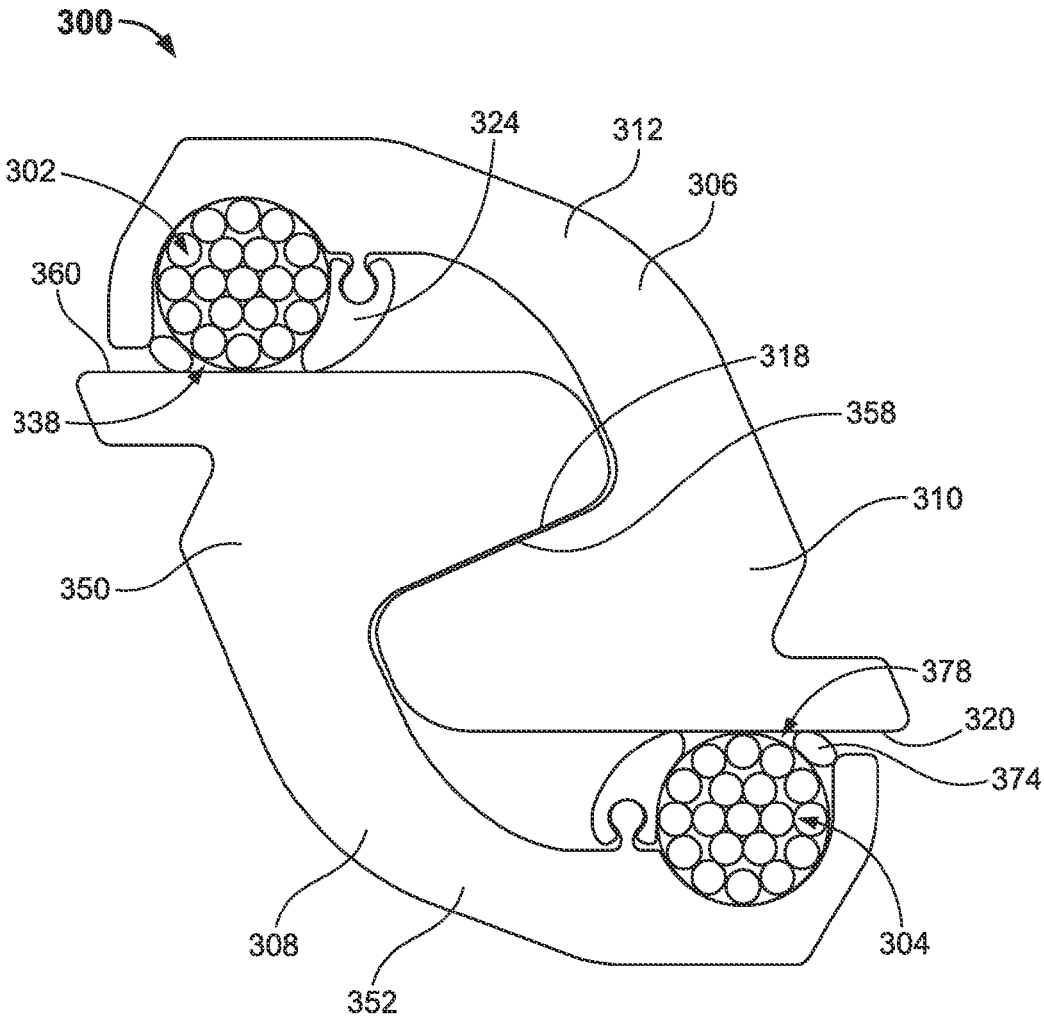
FIG. 14 is a cross-sectional view of the connector assembly shown in FIG. 13 in an assembled state.

FIG. 14 is a cross-sectional view of the connector assembly 300 in an assembled state. In the assembled state, the wedge portions 310, 350 are nested within the spaces created by the channel portions 352, 312, respectively. As such, the connectors 306, 308 are co-nested with one another. As the connectors 306, 308 are being assembled, the inner surfaces 318, 358 slide along one another. As the connectors 306, 308 are advanced, the wedge portions 310, 350 are driven toward the conductors 304, 302, respectively. The forward movement of the wedge portions 310, 350 into the spaces simultaneously forces the outer surfaces 320, 360 outward toward the conductors 304, 302.

The wedge portions 310, 350 also force the jaws 374, 324 to the closed positions around the conductors 304, 302. In the closed positions, the windows 378, 338 expose the conductors 304, 302 to the wedge portions 310, 350. The wedge portions 310, 350 engage the conductors 304, 302 through the windows 378, 338. The jaws 324, 374 help to maintain the conductors 302, 304 in a circular shape and resist flattening of the conductors 302, 304. Flattening may lead to strand gaps being formed between adjacent strands of the conductors 302, 304. However, the jaws 324, 374 resist such flattening and thus resist strand gaps from forming.

Figure 15:
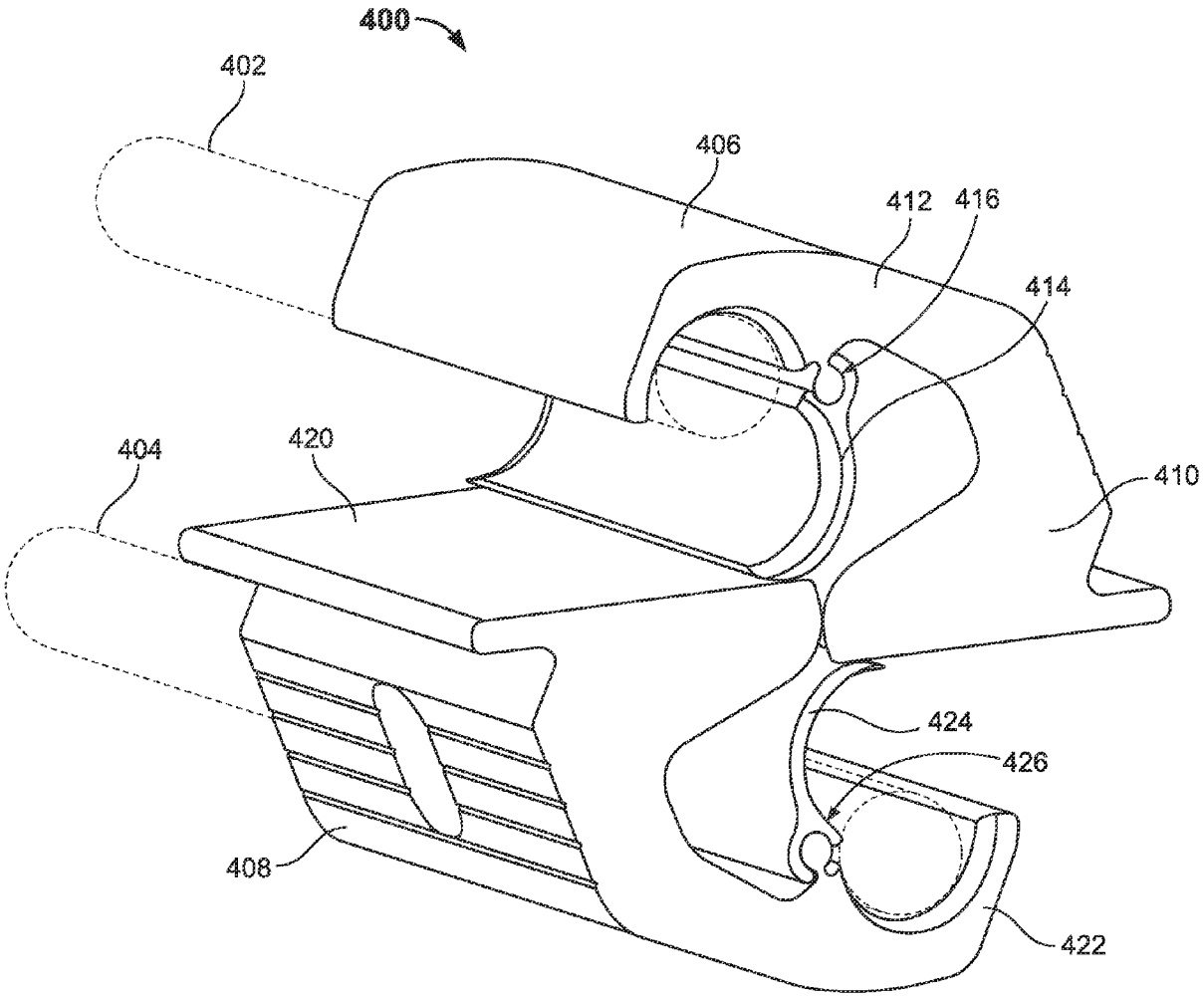
FIG. 15 is a perspective view of another alternative connector assembly formed in accordance with an exemplary embodiment.

FIG. 15 is a perspective view of another alternative connector assembly 400 formed in accordance with an exemplary embodiment. The connector assembly 400 is similar to the connector assembly 300. Like the assembly 300, the assembly 400 includes a tap conductor 402, a main conductor 404, a tap conductive member 406 and a main conductive member 408. The tap conductive member 406 and the main conductive member 408 are configured to be connected to one another using a fastener (not shown) similar to the fastener used to assemble the connector 100.

The tap conductive member 406 includes a wedge portion 410 and a channel portion 412 extending from the wedge portion 410. A jaw 414 is movably coupled to the channel portion 412. The jaw 414 may be pivotably coupled to the channel portion 412 at a hinge 416. The jaw 414 may be similar to the jaw 324 (shown in FIG. 13), however the jaw 414 does not include a window. Additionally, the jaw 414 has a length that is substantially equal to the length of the wedge portion 410 and the channel portion 412. The jaw 414 is movable from an open position, such as the position illustrated in FIG. 15, to a closed position.

The main conductive member 408 includes a wedge portion 420 and a channel portion 422 extending from the wedge portion 420. A jaw 424 is movably coupled to the channel portion 422. The jaw 424 may be pivotably coupled to the channel portion 422 at a hinge 426. The jaw 424 may be similar to the jaw 414. The jaw 424 is movable from an open position, such as the position illustrated in FIG. 15, to a closed position.

In the closed position, the jaw 414 is captured between the wedge portion 420 and the tap conductor 402. Electrical current is transferred from the tap conductor 402 to the main conductive member 408 through the jaw 414. In the closed position, the jaw 424 is captured between the wedge portion 410 and the main conductor 404. Electrical current is transferred from the main conductor 404 to the tap conductive member 406 through the jaw 424.

Figure 16:
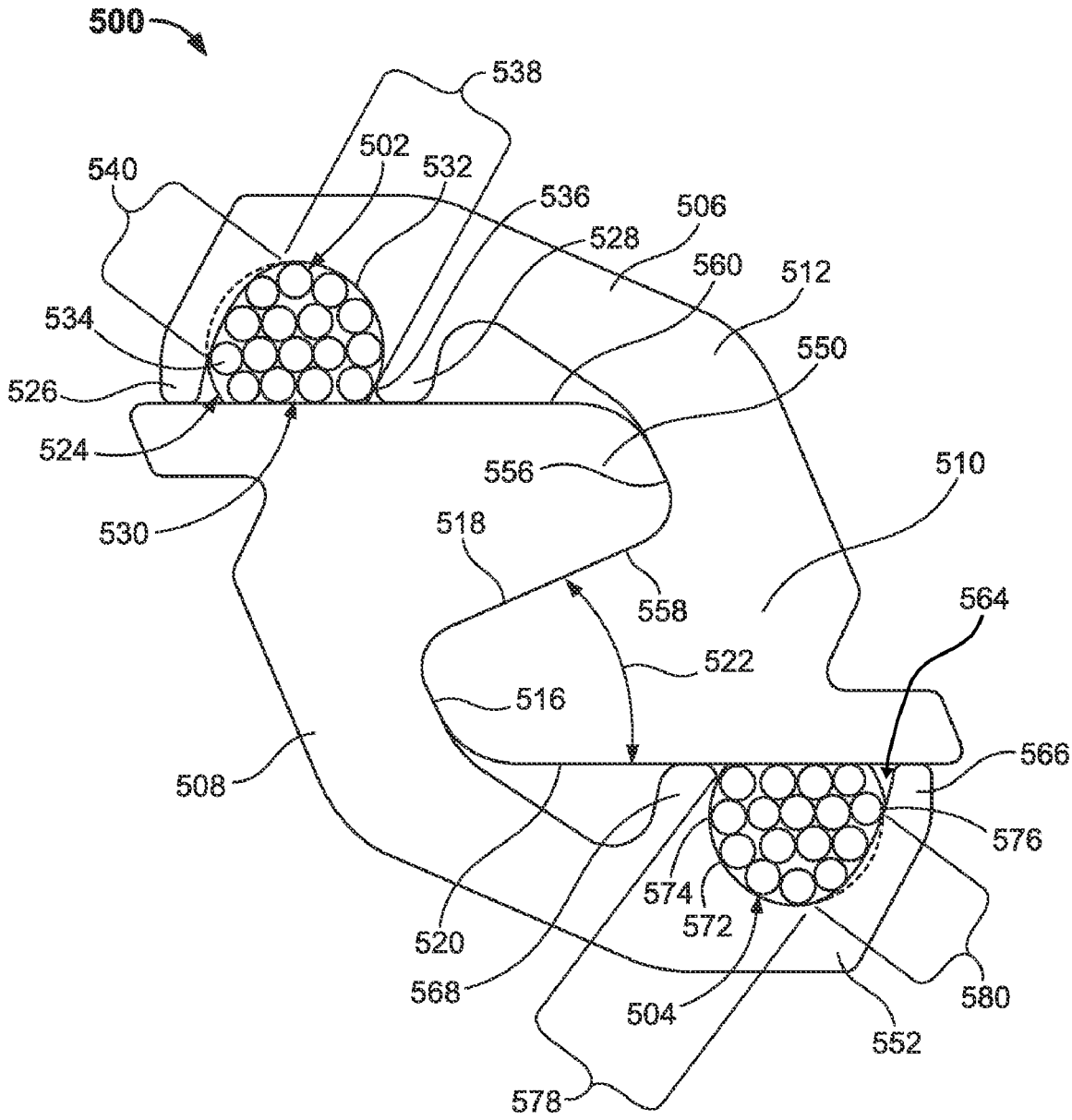
FIG. 16 is a side elevational view of another alternative connector assembly formed in accordance with an exemplary embodiment.

FIG. 16 is a side elevational view of another alternative connector assembly 500 formed in accordance with an exemplary embodiment. The connector assembly 500 is illustrated in an assembled state. The connector assembly 500 is similar to the connector assembly 100. Like the assembly 100, the assembly 500 includes a tap conductor 502, a main conductor 504, a tap conductive member 506 and a main conductive member 508. The tap conductive member 506 and the main conductive member 508 are configured to be connected to one another using a fastener (not shown) similar to the fastener used to assemble the connector 100.

The tap conductive member 506 includes a wedge portion 510 and a channel portion 512 extending from the wedge portion 510. The wedge portion 510 includes an abutment face 516, an inner surface 518 angled with respect to the abutment face 516, and an outer surface 520 that faces the main conductor 504. The outer surface 520 extends obliquely with respect to the inner surface 518. The inner surface 518 and the outer surface 520 are angled with respect to one another at a wedge angle 522. As such, the inner surface 518 and the outer surface 520 together define a wedge structure having an inclined plane for transferring motion during assembly.

The channel portion 512 extends away from the wedge portion 510 and forms a channel or cradle 524 adapted to receive the tap conductor 502 at a spaced relation from the wedge portion 510. The cradle 524 includes opposed fingers 526, 528 that wrap around the tap conductor 502 for about 180 circumferential degrees in an exemplary embodiment. The cradle 524 has an opening 530 between the ends of the fingers 526, 528 that faces toward the wedge portion 510. The cradle 524 overhangs the wedge portion 510 such that, when the connector assembly 500 is assembled, the outer surface 520 spans across the opening 530. The wedge portion 510 closes the cradle 524 and engages a portion of the conductor 502.

The cradle 524 includes a conductor engagement surface 532, which is defined as the portion of the cradle 524 that engages the conductor 502. The conductor engagement surface 532 extends between a first end 534 and a second end 536. Portions of the fingers 526, 528 ray extend outward from the conductor engagement surface 532 when the distal ends of the fingers 526, 528 extend beyond the conductor 502. Alternatively, the conductor engagement surface 532 may extend to the distal end of either or both of the fingers 526, 528.

The conductor engagement surface 532 has a contoured shape that has segments of variable shape. In an exemplary embodiment, the conductor engagement surface 532 is concave between the first and second ends 534, 536, however the radius of curvature is non-uniform. The conductor engagement surface 532 has a compound radius that is not constant from one end to the other. The conductor engagement surface 532 has a non-circular geometry between the first and second ends 534, 536. Optionally, the conductor engagement surface 532 may be elliptical or parabolic in shape. The conductor engagement surface 532 may include at least one flat area between curved areas such that the conductor engagement surface 532 is not curved continuously. However, the cradle 524 has a gross concave shape. In an exemplary embodiment, the cradle 524 is undersized compared to the tap conductor 502 such that the cradle 524 provides an interference fit for the tap conductor 502. As the tap conductor 502 is loaded into the cradle 524, the shape of the conductor 502 changes from a cylindrical shape to an irregular shape. For example, the individual strands of the conductor 502 are moved relative to one another to allow the conductor 502 to fit within the cradle 524. The conductor 502 may be partially flattened. The strands are shifted both at the top of the conductor 502 and at the bottom of the conductor 502 where the conductor 502 engages the main conductive member 508. As such, the strand gaps are minimized by spreading the strand shifting across the entire conductor as opposed to concentrating the strand shilling in one location such as at the bottom of the conductor 502 where the conductor engages the main conductive member 508.

In an exemplary embodiment, the conductor engagement surface 532 has a conforming portion 538 and a non-conforming portion 540. The conforming portion has a radius of curvature that is substantially the same as the radius of curvature of the tap conductor 502. The non-conforming portion 540 has a radius of curvature that is different than the radius of curvature of the conforming portion 538. Optionally, the radius of curvature of the non-conforming portion 540 may be greater than the radius of curvature of the conforming portion 538. As such, the non-conforming portion 540 is relatively flatter than the conforming portion 538. The non-conforming portion 540 has a concave curvature that is different than the concave curvature of the conforming portion 538. Optionally, the conductor engagement surface 532 may have more than one non-conforming portion 540 and/or conforming portion 538. The non-conforming portions may be adjacent to one another or may be separated by the one or more conforming portions 538.

When the conductor 502 is forced into the cradle 524 by the main conductive member 508, the non-conforming portion 540 forces the conductor 502 to change shape and fit into the non-cylindrical shape of the cradle 524. The changing of shape is dynamic during the loading process of the conductor 502 into the cradle 524, wherein the changing of shape occurs while the conductor 502 is loaded into the cradle 524. Such changing of shape of the conductor 502 forces the strands to change position with respect to one another about the entire circumference of the conductor 502. As such, the strand gaps are not concentrated at the interface of the conductor 502 and the main conductive member 508, but rather are spread out along the conductor engagement surface 532 as well.

The main conductive member 508 likewise includes a wedge portion 550 and a channel portion 552 extending from the wedge portion 550. The wedge portion 550 includes an abutment face 556, an inner surface 558 angled with respect to the abutment face 556, and an outer surface 560 that faces the tap conductor 502. The channel portion 552 extends away from the wedge portion 550 and forms a channel or cradle 564 adapted to receive the main conductor 504 at a spaced relation from the wedge portion 550. The cradle 564 includes opposed fingers 566, 568 that wrap around the main conductor 504. The cradle 564 may be substantially similar to the cradle 524. The cradle 564 includes a conductor engagement surface 572 extending between a first end 574 and a second end 576. The conductor engagement surface 532 has a compound radius that is non-uniform. In an exemplary embodiment, the conductor engagement surface 572 has a conforming portion 578 and a non-conforming portion 580. The conforming portion 578 has a radius of curvature that is substantially the same as the radius of curvature of the main conductor 504. The non-conforming portion 580 has a radius of curvature that is different than the radius of curvature of the conforming portion 578.

The wedge portions 510 and 550 of the respective tap and the main conductive members 506, 508 are substantially identically formed and share the same geometric profile and dimensions to facilitate interfitting of the wedge portions 510 and 550 as the conductive members 506, 508 are mated. The channel portions 512, 552 of the conductive members 506 and 508, however, may be differently dimensioned as appropriate to be engaged to differently sized conductors 502, 504 while maintaining substantially the same shape of the conductive members 506, 508.

As shown in FIG. 16, the tap conductive member 506 and the main conductive member 508 are generally inverted relative to one another with the respective wedge portions 510 and 550 facing one another. The channel portion 512 of the tap conductive member 506 extends away from the wedge portion 510 in a first direction and the channel portion 552 of the main conductive member 508 extends from the wedge portion 550 in a second direction that is opposite to the first direction.

During assembly, the conductive members 506, 508 are inverted relative to one another. The wedge portion 510 is aligned with the wedge portion 550 proximate the space between the wedge portion 550 and the channel portion 552. Similarly, the wedge portion 550 is positioned proximate to the space between the wedge portion 510 and the channel portion 512. As the conductive members 506, 508 are coupled one another the outer surfaces 520, 560 are driven away from one another. The outer surface 520 engages the main conductor 504 and the outer surface 560 engages the tap conductor 502.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector assembly comprising:

a first conductive member comprising a first channel portion extending from a first wedge portion, the first channel portion configured to receive a first conductor therein, the first conductive member having a jaw movably coupled to the first channel portion and being positioned between the first channel portion and the first wedge portion; and a second conductive member comprising a second channel portion extending from a second wedge portion, the second channel portion configured to receive a second conductor;

wherein the first wedge portion and the second wedge portion are assembled such that the second wedge portion engages the jaw and moves the jaw to the closed position, the jaw engaging the first conductor in the closed position.

2. The electrical connector assembly of claim 1, wherein the jaw includes a curved seat configured to receive the first conductor, the curved seat and the first channel portion having a similar radius of curvature being similar to a curvature of the first conductor.

3. The electrical connector assembly of claim 1, wherein the jaw is pivotably coupled to the first channel portion at a hinge.

4. The electrical connector assembly of claim 1, wherein the jaw includes a window, the second channel portion being configured to engage the first conductor through the window.

5. The electrical connector assembly of claim 1, wherein the first channel portion includes a cradle configured to receive the first conductor, the cradle being curved, the jaw being curved, the jaw being coupled to the first channel portion proximate to the cradle, wherein the jaw and the cradle cooperate to substantially circumferentially surround the first conductor when the jaw is in the closed position.

6. The electrical connector assembly of claim 1, wherein the first conductor includes multiple strands each having a strand diameter, the strands being held together in a bundle, the first channel portion and the jaw cooperating to hold the strands in the bundle to limit strand gaps between adjacent strands to be less than the strand diameter.

7. The electrical connector assembly of claim 1, wherein the second wedge portion includes an inner surface and an outer surface, the inner surface being angled at a wedge angle with respect to the outer surface, the outer surface engaging the jaw, the inner surface engaging the first wedge portion to drive the outer surface relatively closer to the conductor as the second wedge portion is loaded into the space between the first channel portion and the first wedge portion, the outer surface driving the jaw to the closed position as the outer surface is moved relatively closer to the conductor.

8. The electrical connector assembly of claim 1, wherein the first channel portion is adapted to extend around the first conductor in a first direction, and the second channel portion is adapted to extend around the second conductor in a second direction, the second direction opposite to the first direction.

9. The electrical connector assembly of claim 1, wherein the first conductive member and the second conductive member are substantially identically formed.

10. The electrical connector assembly of claim 1, wherein the second conductive member includes a second jaw movably coupled to the second channel portion and being positioned between the second channel portion and the second wedge portion, the first wedge portion and the second wedge portion being assembled such that the first wedge portion engages the second jaw and moves the second jaw to the closed position, the second jaw engaging the second conductor in the closed position.

11. An electrical connector assembly comprising:

a first conductive member comprising a first channel portion extending from a first wedge portion, the first channel portion having a first cradle configured to receive a first conductor therein, the first cradle having a first conductor engagement surface engaging the first conductor, the first conductor engagement surface having a contoured shape; and a second conductive member comprising a second channel portion extending from a second wedge portion, the second channel portion configured to receive a second conductor;

wherein the first wedge portion and the second wedge portion are adapted to co-nest with one another and be secured to one another once fully mated, the first and second wedge portions have angled ramp surfaces that engage one another and conductor contact surfaces generally opposite the corresponding ramp surfaces, wherein the ramp surfaces are non-parallel with respect to the conductor contact surfaces, the engagement between the ramp surfaces forcing the conductor contact surface of the first wedge portion into the second conductor to drive the second conductor into the second channel portion and forcing the conductor contact surface of the second wedge portion into the first conductor to drive the first conductor into the first cradle as the first and second conductive members are mated.

12. The electrical connector assembly of claim 11, wherein the first conductive member includes a jaw movably coupled to the first channel portion and being positioned between the first channel portion and the first wedge portion, the first wedge portion and the second wedge portion being assembled such that the second wedge portion engages the jaw and moves the jaw to the closed position, the jaw engaging the first conductor in the closed position.

13. The electrical connector assembly of claim 11, wherein the first cradle is undersized compared to the first conductor such that the first conductor changes shape as the first conductor is loaded into the first cradle.

14. The electrical connector assembly of claim 11, wherein the first conductor engagement surface has a noncircular geometry between a first end and a second end of the first conductor engagement surface.

15. The electrical connector assembly of claim 11, wherein the first cradle is sized relative to the first conductor such that the first cradle provides an interference fit with the first conductor for holding the first conductor.

16. The electrical connector assembly of claim 11, wherein the first conductor engagement surface has a conforming portion and a nonconforming portion, the conforming portion having a radius of curvature substantially the same as a radius of curvature of the first conductor, the nonconforming portion having a radius of curvature that is greater than the radius of curvature of the conforming portion.

17. The electrical connector assembly of claim 11, wherein the first conductor engagement surface has a conforming portion and a nonconforming portion, the conforming portion being curved to substantially match a curvature of the first conductor, the nonconforming portion being relatively flat compared to the conforming portion such that the nonconforming portion has a slight curvature.

18. The electrical connector assembly of claim 11, wherein the first wedge portion comprises a first conductor contact surface, the second wedge portion comprising a second conductor contact surface, the first conductor contact surface located adjacent the second channel portion and the second conductor contact surface located adjacent the first channel portion.

19. The electrical connector assembly of claim 11, wherein the first and second conductive members are substantially identically formed with one another and are in abutting contact and interfitting with one another, the second channel portion having a second cradle configured to receive the second conductor therein, the second cradle having a second conductor engagement surface engaging the second conductor, the second conductor engagement surface having a contoured shape.

20. The electrical connector assembly of claim 11, wherein the first channel portion and the second wedge portion cooperate to capture the first conductor when the first and second conductive members are mated, and wherein the second channel portion and the first wedge portion cooperate to capture the second conductor when the first and second conductive members are mated.

21. The electrical connector assembly of claim 11, wherein the first wedge portion and the second wedge portion are adapted to nest with one another such that the ramp surfaces of the first and second wedge portions engage one another and slide along one another during assembly to capture and electrically connect the first and second conductors.

22. The electrical connector assembly of claim 11, wherein the first and second conductors are aligned with one another along a conductor bisector plane extending between central axes of the first and second conductors, the conductor contact surfaces of the first and second wedge portions being generally perpendicular to the conductor bisector plane and the ramp surfaces of the first and second wedge portions being transverse to the bisector plane.

23. The electrical connector assembly of claim 11, wherein the first wedge portion and the first channel portion define a generally U-shaped body creating a space therebetween with an open end, the first wedge portion and the first channel portion are generally aligned with one another on opposite sides of the space and extend to outer ends with the open end between the outer ends of the first wedge portion and the first channel portion, the second wedge portion being received through the open end and being configured to nest within the space created between the first wedge portion and the first channel portion; and wherein the second wedge portion and the second channel portion define a generally U-shaped body creating a space therebetween with an open end, the second wedge portion and the second channel portion are generally aligned with one another on opposite sides of the space and extend to outer ends with the open end between the outer ends of the second wedge portion and the second channel portion, the first wedge portion being received through the open end of the second conductive member and being configured to nest within the space created between the second wedge portion and the second channel portion;

the first wedge portion engaging the second wedge portion to drive the second wedge portion relatively closer to the first channel portion.

24. The electrical connector assembly of claim 11, wherein the first and second wedge portions are positioned between the first and second conductors and wherein the first and second channel portions are positioned outside of the first and second conductors, the engagement between the first and second wedge portions deflecting the first and second channel portions outward when the first and second conductive members are mated.

* * * * *

UNITED STATES PATENT AND TRADEMARK OFFICE

CERTIFICATE OF CORRECTION

PATENT NO. : 7,997,943 B2
APPLICATION NO. : 12/509246
DATED : August 16, 2011
INVENTOR(S) : Owen Ross Gregory et al.

It is certified that error appears in the above-identified patent and that said Letters Patent is hereby corrected as shown below:

On the title page, item [73] should read:
Assignee: Tyco Electronics Corporation, Berwyn, PA (US) and
Tyco Electronics Canada ULC, Markham, Ontario (CANADA)

Signed and Sealed this
Twenty-fourth Day of January, 2012

David J. Kappos

David J. Kappos
*Director of the United States Patent and Trademark Office*